United States Patent [19]

Falkenberg

[11] 4,139,733

[45] Feb. 13, 1979

[54] ELECTRO ACOUSTIC TRANSDUCER WITH IMPROVED DIAPHRAGM

[75] Inventor: Werner Falkenberg, Berlin, Fed. Rep. of Germany

[73] Assignee: BM-Elektronik Meletzky KG, Fed. Rep. of Germany

[21] Appl. No.: 882,090

[22] Filed: Mar. 1, 1978

[30] Foreign Application Priority Data

Mar. 1, 1977 [DE] Fed. Rep. of Germany ..... 2709374

[51] Int. Cl.[2] ..... H04R 7/14; H04R 7/26; H04R 9/02; H04R 9/06

[52] U.S. Cl. ..... 179/1 F; 179/115.5 R; 179/181 R; 181/166; 181/170; 181/173

[58] Field of Search ..... 179/1 F, 115.5 R, 181 F, 179/181 R; 181/163, 164, 166, 167, 168, 169, 170, 173

[56] References Cited

U.S. PATENT DOCUMENTS

| | | | |
|---|---|---|---|
| 1,895,494 | 1/1933 | Smythe | 181/164 |
| 1,997,790 | 4/1935 | Heidrich | 181/163 |
| 2,233,244 | 2/1941 | Compare | 179/115.5 R |
| 3,939,942 | 2/1976 | Gore | 181/167 |
| 4,045,695 | 8/1977 | Itagaki et al. | 179/1 F |

*Primary Examiner*—George G. Stellar
*Attorney, Agent, or Firm*—McGlew and Tuttle

[57] ABSTRACT

The invention relates to an electroacoustic transducer for the sound reproduction, comprising a substantially olive-shaped diaphragm body formed of a plurality of convexly pre-curved diaphragm segments capable of bending, damping material accommodated within the diaphragm body, at least one oscillation generator provided on one end of the diaphragm body and having its moving coil connected to the diaphragm body, and means for rigidly connecting the other end of the diaphragm body to the housing of the oscillation generator.

7 Claims, 3 Drawing Figures

ELECTRO ACOUSTIC TRANSDUCER WITH IMPROVED DIAPHRAGM

An electroacoustic transducer of this kind is known from the French Pat. No. 862 867. This transducer, the damping material accommodated within the diaphragm body is disk-, cube-, or olive-shaped and the outer extent of this olive-shaped damping body is smaller than the inside extent of the olive-shaped diaphragm body, and the damping body is perforated to allow air passage therethrough. Upon excitation by the moving coil of the oscillation generator, the diaphragm segments of this prior art diaphragm body experience deformations both axially and radially, with the portions of the diaphragm segments vibrating axially in phase with the moving coil being in opposition of phase to the radially vibrating portions of the diaphragm segments. Both non-linear and linear distortions, particularly of low frequencies, result therefrom. In addition, the transverse waves forming in the diaphragm segments lead to interferences and thus to distortions in the sound reproduction.

In contradistinction thereto, the invention is based on the problem of providing an electroacoustic transducer of the above mentioned kind, having a diaphragm body which is capable of oscillating without distortions, so that a well-defined radial radiation of equal-phase oscillations is obtained.

To solve this problem, the invention provides that the individual diaphragm segments are formed of at least two layers of unequally hard materials, of which the outer layer having to radiate the sound is made of a hard material and the inner layer or layers are made of softer materials growing softer in the inward direction, that the individual multilayer diaphragm segments are connected to each other by resilient strips forming crimps, that in accordance with the frequency range they have to reproduce, the length and curvature of the individual diaphragm segments is located immediately adjacent the ends subjected to the axially directed vibration forces of the diaphragm body, whereby the location of the center of deflection is defined to the effect that the deflections of the diaphragm segments on the periphery of the diaphragm body always exceed the axially directed amplitudes of the moving coil, and that the damping material accommodated within and filling the diaphragm body biases the diaphragm segments in the radially outward direction.

Since due to the inventive design of the diaphragm body, the individual diaphragm segments experience during the deflections a greater resistance in the inward direction than in the outward direction, the asymmetry of the amplitudes of the diaphragm segments relative to their mean positions is compensated.

By providing the center of deflection of the diaphragm segments directly adjacent the ends of the diaphragm body, the movements of the diaphragm segment portions vibrating in opposition of phase are reduced to an extent such that they cannot lead to cancellations or distortions of the oscillations and also eliminate surface losses of the diaphragm body.

By center of deflection, the point in the inventive diaphragm body is understood about which a change in the direction of oscillation takes place, i.e. from the axial direction of oscillations in phase with the moving coil to the radial direction in which the diaphragm segments are to vibrate.

The inventive displacement of the center of deflection to the rim or the ends of the diaphragm body has the further advantage of a small curvature of the diaphragm segments, having the effect of a high ratio of translation. That is, the amplitudes of the moving coil are translated into considerably larger amplitudes of the radiating diaphragm segments, so that with relatively large diaphragm surfaces utilizable in the subject matter of the invention, extremely small amplitudes of the moving coil, for example, of 0.5 to 1.5 mm, may be provided.

The result thereof is that due to the quadratic relation between the intensity of the magnetic field and the area of the polar surface, a strongly concentrated magnetic field can be produced, additionally permitting a high mechanical and electrical damping of the moving coil.

In accordance with the invention, the moving coil is not suspended in the conventional manner from an easily movable centering mount, but is disposed by its upper coil neck in a rubber body which counteracts overshoots of the diaphragm segments and prevents distortions of low frequencies in the same way.

The inventive location of the center of deflection directly adjacent the ends of the diaphragm body can be effective only within limited frequency ranges, so that in accordance with the invention, if a wide frequency range is to be covered, a plurality of diaphragm bodies of different sizes and, preferably, axially aligned one above the other, are used.

The higher the radiated frequency range of the respective diaphragm body, the shorter is the length and smaller the curvature of the diaphragm segments. In consequence, with extremely high frequencies, the diaphragm body becomes a short tube (of only some centimeters in length) with a but slightly enlarged middle portion. Higher radiation performances are obtained, in accordance with the invention, by providing moving coils of larger diameter while maintaining the location of the center of deflection of the diaphragm segments, which is equivalent to larger diaphragm surfaces with, however, the amplitudes and the omnidirectional radiation pattern unchanged.

In contradistinction thereto, with conventional transducers of the prior art, an enlargement of the diaphragm impairs the conditions of radiation, particularly because of the annoying directional effect of the high-frequency content, for example, in transducers having parallel oscillating surfaces.

The radiation of the inventive transducer is therefore less spherical and the propagation in all directions takes place rather in plane sound waves the energy of which does not decrease as rapidly as that of a spherical wave where it must disperse over spherical surfaces progressively increasing with the distance. In connection with this and the nondirectional sound radiation, it is to be noted that the inventive transducer shows an acoustic phenomenon hitherto unknown, namely that while approaching the transducer, no increase of the sound intensity is perceptible, but at a larger distance from the transducer, an intensified sound is perceived.

Thus, the inventive transducer is not bound to a specific location and may be listened to from both a closest and large distances without perceiving an impairment of the sound intensity, for example, in the stereo effect.

The individual diaphragm bodies of unequal size may be assembled either through separate magnetic systems or, preferably, directly to each other and driven by a single, common oscillation generator. This arrangement may be considered equivalent to an electrical filter, since due to the inventive design, the axial oscillations do not become effective in the axial direction but only in the radial direction in which they are radiated by the diaphragm body dimensioned for the respective frequency range.

In this embodiment, due to the subdivision and the connection by means of a radially non-expandable member, for example, a ring or disk, each individual diaphragm body forms a vibratory system closed in itself and the last, larger system is connected to the driving magnet or the housing through a rigid central connecting rod.

The moving coil is connected to the smaller diaphragm body provided for the higher frequencies, so that due to the radial deflections of the diaphragm segments of this body, the higher frequency content is kept from the larger diaphragm body.

The lower frequencies are passed on axially and thus broken down and brought to radiation through the respective diaphragm bodies.

In another embodiment of the invention, soft piezoelectric foils in the form of strips are glued to the diaphragm segments on the surface thereof or within the individual diaphragem layers, and the voltage they deliver during the vibration of the diaphragm segments is used for a negative feedback within the amplifying stage, to reduce distortions to a minimum.

This provision is particularly well suited for the inventive design, since the piezoelectric bender elements are largely equivalent to those of the oscillating diaphragm segments and become effective only at the occurence of distortions. This is in contrast with transducers of the prior art in which, in the majority of cases, negative feedback voltages are produced at the moving coil, which are by no means identical with the free, uncontrolled partial oscillations of their diaphragms.

The diaphragm segments are connected to each other by strips forming crimps. In small diaphragm bodies, the diaphragm segments may be connected to each other directly, since they are made transversely resilient by impressed longitudinal flutes.

Within the diaphragem bodies, resilient damping material is received filling the entire interior space of the diaphragm body and joining with the diaphragm segments in an interlaced contact zone and biasing the segments in the outward direction. More particularly, foam rubber, foam material, glass fiber, wadding, or the like, are used as the filling material. To a certain extent, the filling material is subjected to the vibratory motion and deformation and the diaphragm body. The individual layers of the diaphragm segments are joined to each other, particularly, by elastic adhesives.

In the following, the invention is explained in more detail with reference to an embodiment shown in the drawings in which.

Figure 1:
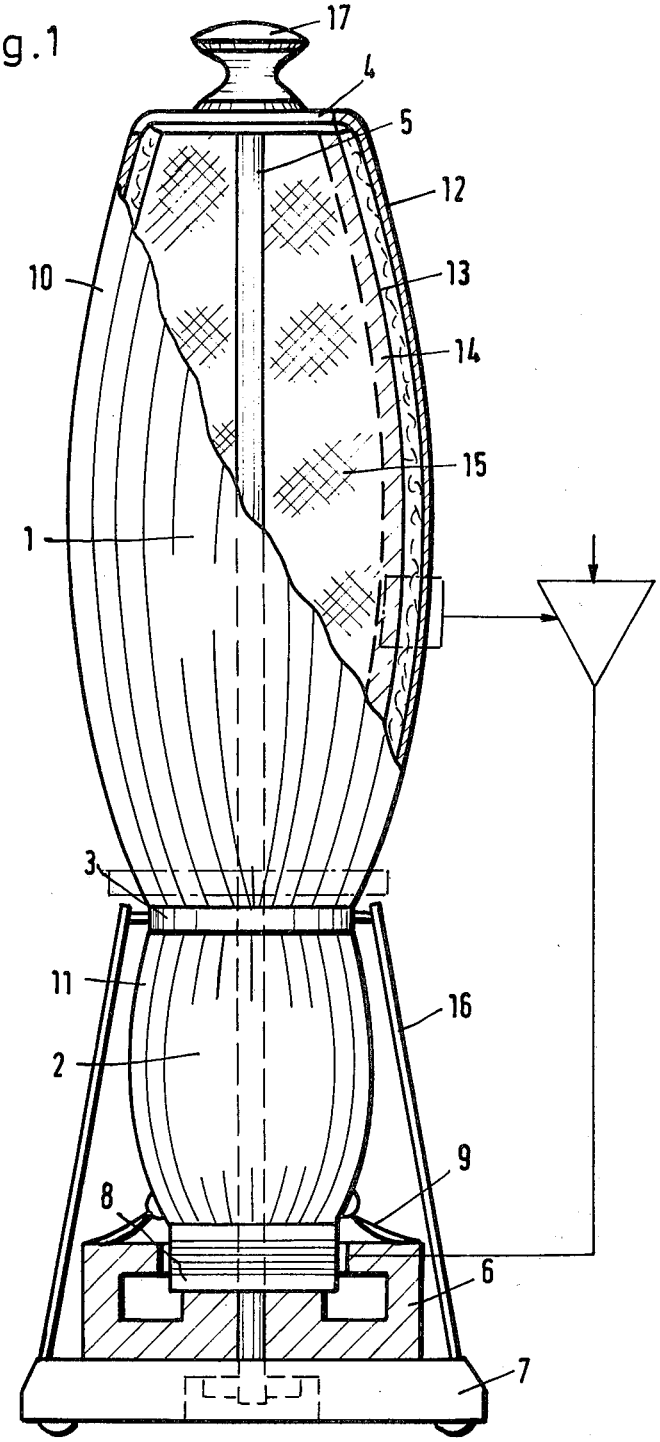
FIG. 1 is a view of an inventive transducer comprising two diaphragm bodies of unequal size, for distributing the frequencies.

The electroacoustic transducer comprises two diaphragm bodies 1, 2, of which diaphragm body 1 radiates low frequencies and diaphragm body 2 radiates high frequencies. In their plane of junction, the two substantially olive-shaped diaphragm bodies 1, 2 are connected to each other by a disk-shaped rigid body 3 comprising a radially non-expandable ring or disk. On its upper end, diaphragm body 1 is connected to a rigid counterplate 4 which is firmly screwed, by means of a rigid connecting rod 5, to the magnet 6 and the base plate 7 of an oscillation generator. The moving coil 8 of the oscillation generator is connected to the small diaphragm body 2 which, in its portion closely above the line of application of moving coil 8, is surrounded by a rubber body 9 which has a centering function and acts as a return force and may be designed as a diaphragm.

Figure 2:
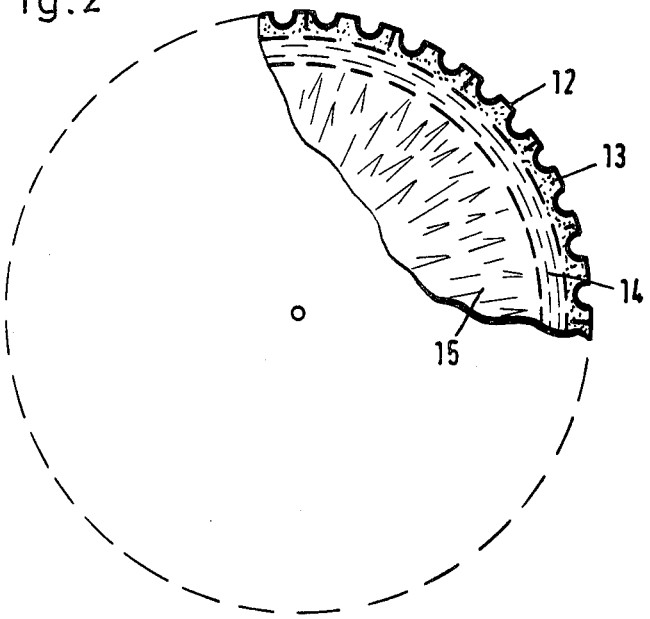
FIG. 2 is a sectional view of a small diaphragm body.
Figure 3:
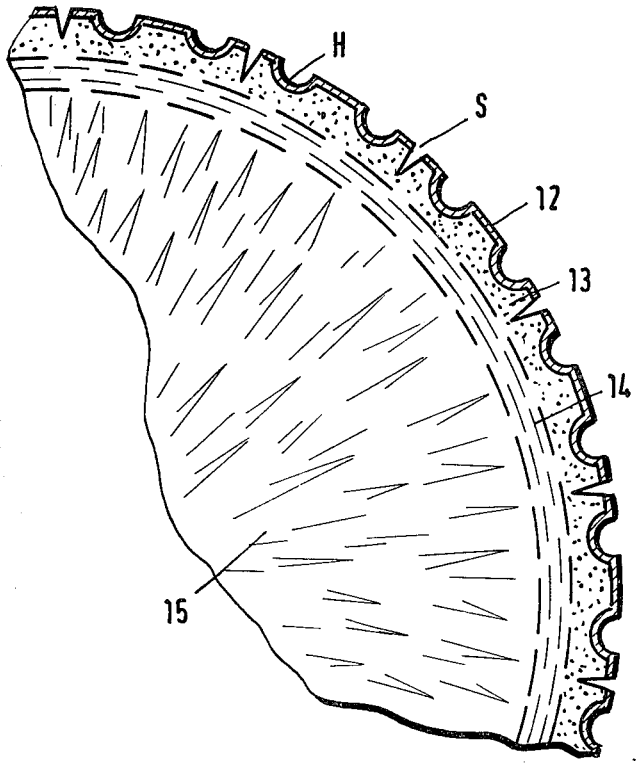
FIG. 3 is a sectional view of a large diaphragm body.

The individual diaphragm segments 10, 11 of each diaphragm body 1, 2 are formed of a plurality of layers 12, 13, 14 of unequally hard materials, of which the outer layer 12 intended for the sound radiation is made of a hard material, particularly aluminum or a foil of plastic, and the inner layers 13, 14 are made of a soft material, particularly foam plastic. The inner layer 14 is interlaced with an internal filling 15 of diaphragm body 1, 2, which may comprise glass fiber, wadding, or the like, so that it strains or biases the diaphragm segments 10, 11 radially outwardly. Diaphragm segments 10, 11 are provided with longitudinally continuously extending flutes H (FIGS. 2, 3) which contribute to an increased rigidity and reduce the mass. Further, these flutes H provide a desired elasticity in the transverse direction of diaphragm segments 10, 11, thus tangentially of the periphery of diaphragm body 1, 2. Crimps S (FIG. 3) are provided for connecting diaphragm segments 10, 11 to each other.

The small diaphragm body 2 is protected against damaging by a frustoconical metal sheet covering 16 which is perforated and permeable to sound. There is less need for protecting the larger diaphragm body 1 provided for medium and low frequencies, since it is made of a stronger material.

The termination on the top by a hand button 17 substantially facilitates the handling of the transducer, which has frequently been a problem with conventional transducers.

I claim:

1. An electroacoustic transducer for the sound reproduction, comprising a substantially olive-shaped diaphragm body formed of a plurality of convexly precurved diaphragm segments capable of bending, damping material accomodated within the diaphragm body, at least one oscillation generator provided at one end of the diaphragm body and having its moving coil connected to the diaphragm body, and means for rigidly connecting the other end of the diaphragm body to the housing of the oscillation generator, characterized in that the individual segments (10, 11) of the diaphragm body are formed of at least two layers (12, 13, 14) of unequally hard materials, of which the outer layer (12) intended for radiating the sound is made of a hard material and the inner layer or layers (13, 14) are made of softer materials growing softer in the inward direction, that the individual multilayer diaphragm segments (10, 11) are connected to each other by resilient strips forming crimps (S), that in accordance with the frequency range they have to reproduce, the length and curvature of the individual multiplayer diaphragm segments (10, 11) are so dimensioned that the center of deflection of the diaphragm segments (10, 11) is located immediately adjacent the ends subjected to the axially directed oscillation forces of the diaphragm body (1, 2), whereby the location of the center of deflection is defined to the effect that the deflections of the diaphragm segments (10, 11) on the periphery of the diaphragm body (1, 2) always exceed the axially directed amplitudes of the moving coil (8), and that the damping material (15)

accomodated within and filling the diaphragm body (1, 2) biases the diaphragm segments (10, 11) in the radially outward direction.

2. An electroacoustic transducer according to claim 1, characterized in that to increase their longitudinal stability and transverse elasticity, the diaphragm segments (10, 11) are provided with longitudinal through flutes (H), so that in smaller diaphragm bodies (2), it is possible to connect the diaphragm elements (11) to one another on their edges directly, without the use of resilient crimps (S).

3. An electroacoustic transducer according to claim 1 or 2, characterized in that to break down the frequencies, two or more diaphragm bodies (1, 2) of unequal size are directly attached to each other in axial alignment, that each diaphragm body (1, 2) is connected to the next larger one by a radially non-extensible ring or a rigid disk (3), and that the moving coil (8) of an oscillation generator is provided on one of the free ends of the small diaphragm body (2) while a counterplate (4) is fixed to the opposite free end of the large diaphragm body (1) and connected, through a rigid connecting rod (5), to the magnet (6) or the bottom plate (7) of the oscillation generator.

4. An electroacoustic transducer according to claim 1 or 2, characterized in that two or more diaphragm bodies (1, 2) of unequal size are attached directly to each other in axial alignment (5) and connected to each other by radially non-extensible rings or disks (3), and that the diaphragm bodies (1, 2) are driven by separate oscillation generators which are associated each with one diaphragm body (1, 2).

5. An electroacoustic transducer according to claim 1, characterized in that the damping material (15) accomodated within the diaphragm body (1, 2) fills the entire interior space of the diaphragm body (1, 2) up to the inside surface of the inner layer (14), and is free from air inclusions.

6. An electroacoustic transducer according to one of claim 1, characterized in that in a tweeter, the diaphragm body (1, 2) comprises only a short tubular, small-mass diaphragm which is slightly enlarged in its central portion.

7. An electroacoustic transducer according to one of claim 1, characterized in that piezoelectric bender elements are provided on the surface or within the individual layers of the diaphragm segments (10, 11) and that the voltage delivered by the elements during the oscillation of the diaphragm segments (10, 11) is used for a negative feedback within an amplifier.

* * * * *